United States Patent [19]

Dougherty et al.

[11] Patent Number: 4,908,995

[45] Date of Patent: Mar. 20, 1990

[54] RAIL GRINDING METHOD AND APPARATUS

[75] Inventors: Lawrence W. Dougherty, Sleepy Hollow; James R. Fendley, Arlington Heights; William H. Meyle, Naperville; James L. Kraner, Barrington, all of Ill.

[73] Assignee: Zenith Electronics Corporation, Glenview, Ill.

[21] Appl. No.: 140,464

[22] Filed: Jan. 4, 1988

[51] Int. Cl.[4] ..... B24B 7/04

[52] U.S. Cl. ..... 51/281 R; 51/237 T; 51/216 ND; 51/217 R; 51/240 GB

[58] Field of Search ..... 51/281 R, 283 R, 327, 51/217 R, 217 L, 240 R, 240 GB, 216 ND, 237 T; 313/407, 408, 286; 269/254 CS, 233

[56] References Cited

U.S. PATENT DOCUMENTS

| | | | |
|---|---|---|---|
| 2,543,236 | 2/1951 | Dackor et al. | 51/237 T |
| 4,695,761 | 9/1987 | Fendley | 313/407 |
| 4,704,094 | 11/1987 | Stempfle | 445/30 |
| 4,711,438 | 12/1987 | Guarino | 269/254 CS |

FOREIGN PATENT DOCUMENTS

| | | | |
|---|---|---|---|
| 0096527 | 6/1982 | Japan | 269/254 CS |
| 0124721 | 7/1984 | Japan | 269/254 CS |

*Primary Examiner*—Robert Rose

[57] ABSTRACT

For use in the manufacture of flat tension mask cathode ray tubes, a method for forming on a mask support structure a mask receiving surface in a plane parallel to and at a precise fixed distance from the plane of the inner surface of a glass front panel embodying the tube's viewing screen.

6 Claims, 3 Drawing Sheets

RAIL GRINDING METHOD AND APPARATUS

BACKGROUND OF THE INVENTION

1. Field of the invention:

This invention applies to shaping parts in the manufacture of flat tension mask color cathode ray tubes. More specifically, the invention describes a means for forming a smooth, uniform and burr-free surface to which a tensed foiled shadow mask will be permanently affixed.

In particular the invention relates to a portion of the process steps employed in the manufacture of a front assembly of a flat tension mask color cathode ray tube. A front assembly includes a flat glass panel, planar on one side defined as the inner surface of the panel, a support structure affixed to the inner surface of the panel and a tensed foil shadow mask permanently attached to the support structure with proper registration relative to the color emitting phosphors, applied to the inner surface within the boundaries imposed by the support structure perimeter. Such a front assembly is described in U.S. Pat. No. 4,686,416.

2. Definitions

Certain definitions of terms and phrases used in this disclosure add to the clarity of the description of the invention.

Tube: The term "tube" in this disclosure means a flat tension mask cathode ray tube such as that used as a color television receiver screen or as a color computer monitor screen.

Panel: The front portion of the tube which functions as the viewing screen is a relatively thick flat glass plate.

Mask: An essential part of a tube is a thin metal shadow mask placed close to and behind the inner surface of the panel. In the preferred embodiment of this disclosure, the shadow mask is described as being made of steel and as being permanently affixed to a support structure by means of laser welding.

Support Structure and Rail: For proper functioning of the cathode ray tube, the mask is permanently installed, with proper orientation, in a plane at a specified distance from the inner surface of the panel. The support structure may be part of the panel or made of separate elements attached to the panel. In the illustrated preferred embodiment, the mask is permanently affixed to a support structure consisting of a continuous metal rectangular frame bonded to the panel by a process called fritting. In this document, the metal rectangular structure is called the "support structure". Any one side of the support structure is called a "rail".

Land and Mask Receiving Surface: In preparation for welding, the top surface of the support structure is ground flat. The ground surface of the support structure to which the mask is welded is called the "land" or the "mask receiving surface".

Fixture: The entire tooling system used to hold the panel during the grinding process as described in the preferred embodiment is called the "fixture".

3. Reference to Prior Art:

There is no known prior art related to forming a flat planar surface on the support structure for a flat tension mask cathode ray tube. Grinding of flat planar surfaces is well established in terms of available machinery and grinding media, but this application introduces requirements not encountered outside the field of manufacturing flat tension mask color cathode ray tubes.

4. Problems in the Manufacture of Flat Tension Mask Cathode Ray Tubes:

The materials of the parts to be held and ground prior to final assembly do not lend themselves to being clamped in position by common methods. The degree of precision and processes required for positioning the mask relative to the inner surface demand the unique methods described herein.

What follows is a number of the problems addressed and solved by the invention:

A. Checking and Cracking: If the glass in the panel is scratched during manual handling while being clamped in the grinding position, such surface blemishes induce stress concentrations at the scratches. This introduces the possibility of breakdown in the structure of the glass when the panel is subsequently subjected to high temperatures during the sealing of the tube. Such damage may render the tube inoperable or a total loss. To reduce the possibility of scratching the panel, holding clamps of the fixture must be applied directly to the panel without any rotational or sliding motions while the clamps are in contact with the panel.

B. Metal Softness: The support structure is preferably made of a 28% chromium-iron alloy commonly known of as "Carpenter Glass Sealing 27". It is difficult to grind such a material and produce a surface with edges free of burrs. Burrs tear the thin material of which the mask is made during the mask application and attachment process. Also, burrs may break free from the support structure of a finished tube and create charged particles which can cause electrical problems.

C. Accuracy: The mask is used as a photoexposure mask in the photolithographic processes for applying the black grille and three color emitting phosphors; therefore, use of the mask in said photolithographic processes dictates its precise repetitive placement and final permanent attachment in proper registration relative to the inner surface of the panel. The mask must be positioned a specified distance from all points of the inner surface during the photolithographic processes and again at final assembly. This specified distance is called the "Q" spacing of the tube and is related to electrical and mechanical geometry of the tube. For the purpose of illustration, the Q spacing of a typical 14" diagonal screen flat tension mask cathode ray tube is approximately 0.290". This dimension is used as the specified distance in the description of the preferred embodiment.

The panel is flat on the inner surface within an overall flatness specification of approximately 0.002" prior to the support structure fritting process. The 0.290" dimension must be maintained within a grinding tolerance on the order of plus or minus 0.002" at all points in the plane of the land.

D. Close Proximity: The 0.290" dimension demands that the grinding wheel operate within 0.290" of the inner surface, and that the inner surface be the reference surface. Therefore, the thickness of the holding clamps must be less than 0.290".

E. Grinding Forces: Grinding forces cannot exceed clamping forces.

OBJECTIVES AND ADVANTAGES OF THE INVENTION

The primary object of the invention is to provide a means for grinding a smooth burr-free mask receiving surface, or land, on a support structure wherein the prescribed surface is in a plane a specified distance from all points in the plane of the inner surface of a panel.

It is an object of the invention to achieve the required accuracy by means of a fixture which exerts sufficient clamping force to overcome required grinding forces, even though the inner surface of the panel is in close proximity of the grinding wheel.

A further object of the invention is to devise a grinding method capable of producing a flat planar surface.

Another object of the invention is a fixture that applies no rotary or sliding motions while its clamps are in contact with the glass of the panel, thereby eliminating any scratching which may cause deterioration of the glass during subsequent high temperature operations.

Lastly, it is an object of the invention to provide for an inprocess gauging procedure to verify that the grinding process has been executed within the prescribed tolerance of approximately plus or minus 0.002".

DESCRIPTION OF THE PREFERRED EMBODIMENT

The Fixture

Clamping: The essence of the fixture 100 is described in FIG. 1. More detail of the clamping forces and how the inner surface of the panel is positioned relative to the cutting surface of the grinding wheel are shown in FIG. 2*a* and FIG. 2*b*.

Figure 2A:
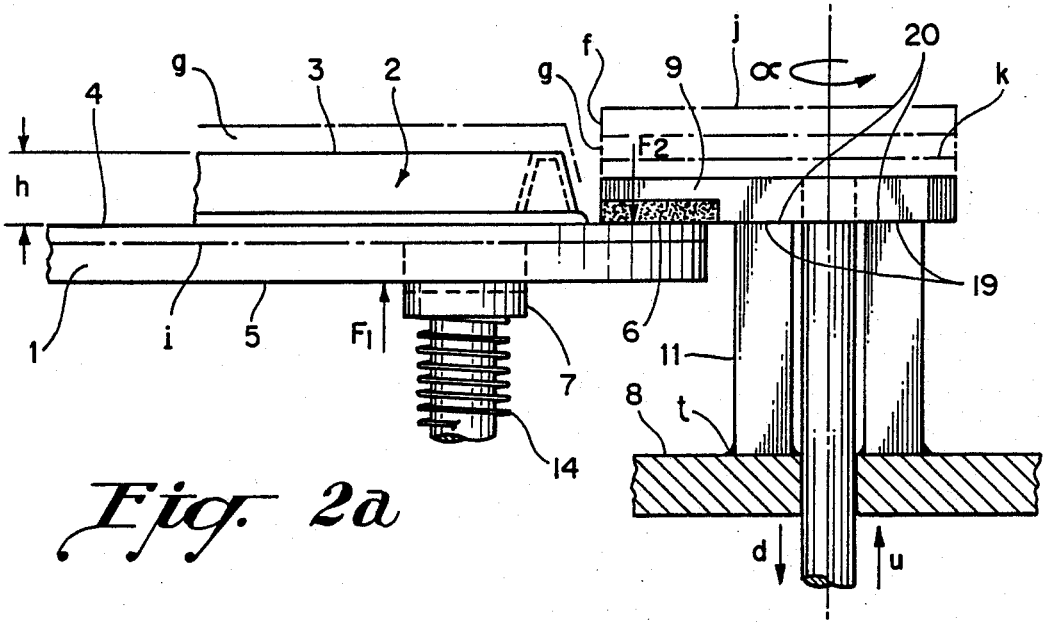
FIG. 2*a* illustrates one corner of the FIG. 1 fixture and the motion of the holding clamps and shows how the inner surface of the panel is precisely referenced relative to the grinding wheel.
Figure 2B:
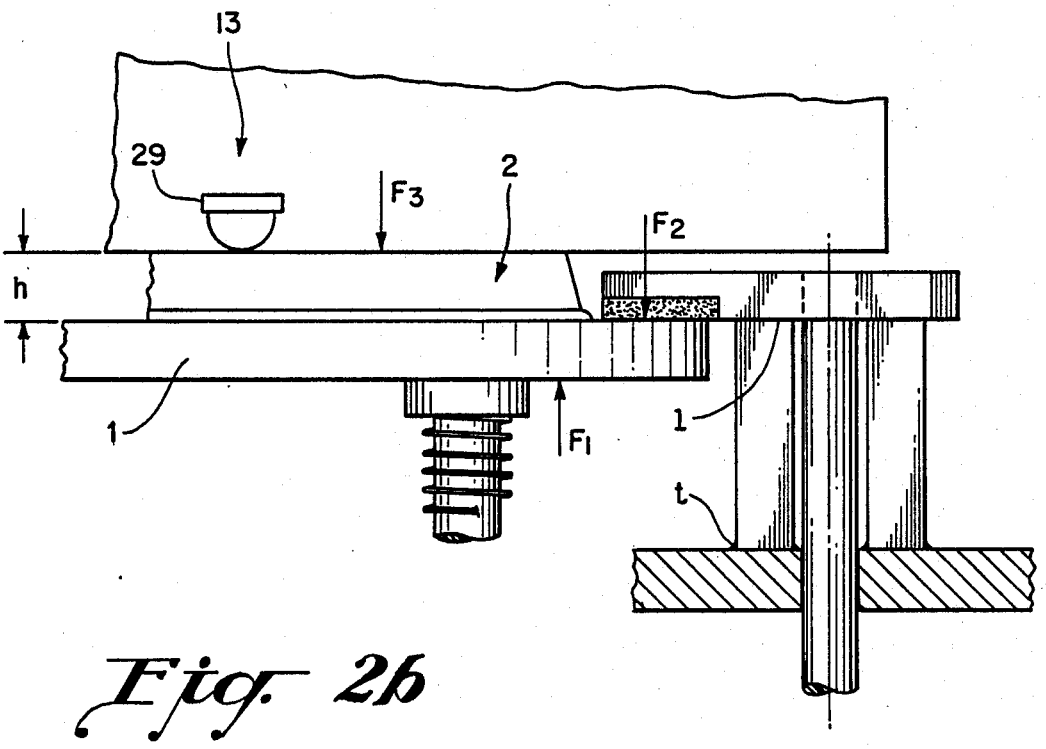
FIG. 2*b* the grinding wheel in close proximity to the inner surface of the panel and the fixture clamps. The forces exerted in the grinding process are indicated. Also indicated is the ball contact of a linear differential transformer used for automatic measurement of rail height after completion of grinding while the panel is still in the fixture.

It is important to the success of the invention that the panel 1 with its support structure 2 be securely held with its inner surface 4 as the reference surface relative to the position of the grinding wheel 13, shown in FIG. 2*b*. Because the distance from the outer surface 5 to the inner surface can vary as much as plus or minus 0.020", the fixture is designed specifically to reference to the inner surface 4.

Figure 1:
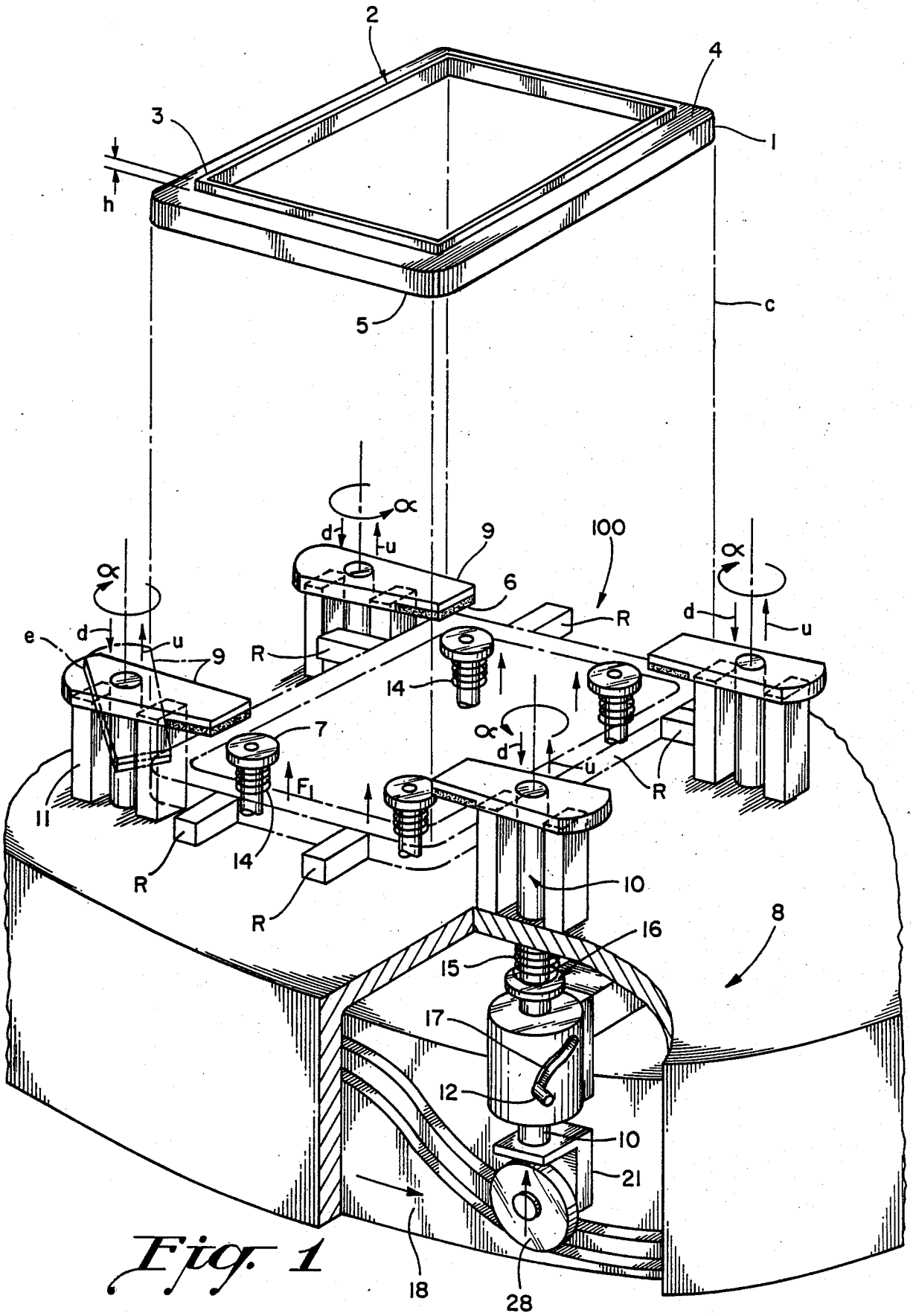
FIG. 1 is a view of the assembled panel and mask support structure exploded from a fixture designed to meet the objectives of the invention.

In FIG. 1, the panel 1 is shown with the support structure 2 fritted in place. At the start of the grinding operation, the rails of the support structure 2 are in an unground state; hence, the dimension h is initially undetermined. From 0.005" to 0.019" of material is typically removed in the process of grinding to produce the land 3.

The vertical broken lines at c suggest how the panel 1 with the support structure fits into the fixture 100. Plastic locating blocks R prevent glass-to-metal contact while panels are being loaded into the fixture and while panels are being unloaded from the fixture.

When the panel 1 is loaded into the fixture, the clamps 9 are in the open position as indicated by the phantom lines at e to permit access of the panel to the fixture where it fits within the locating blocks marked R. When the panel is loaded into the fixture, it rests on four spring loaded plastic buttons 7.

As the machine table 8 moves to the grinding position, to be explained below, a camming action causes the four clamps 9 to rotate through an angle $\alpha$ and move down in the direction d to the closed position. In the closed position the pads 6, permanently affixed to the clamps 9, are in contact with the panel 1 holding it securely against the buttons 7. The buttons and the pads are made of a smooth but hard plastic material such as Delrin. The plastic is less hard than the glass but is of sufficient hardness that it maintains dimensional stability. Also, it is of such relative softness that any grit or process waste material will displace some of the plastic thus preventing the glass surface from being damaged when the clamps are in contact with the panel.

The action of the clamps 9 is such that no rotational or sliding components of motion are applied to the inner surface 4 of the panel 1 in the process of clamping. The lower center of FIG. 1 suggests a means for operating the clamps in such a manner that only vertical motion of the clamp stems 10, and hence the clamps 9, as indicated by u and d occurs in the close proximity to the panel. Once the pads 6 break contact with the inner surface 4, rotational motion is executed to open the fixture for removal of the panel 1.

While the details of the actuation system are not specific in FIG. 1, the essential concepts of the actuation system are shown. Fastened directly to the base of the grinding machine, under the machine table 8, is a ring shaped cam 18 which moves the stems 10 by means of a linkage mechanism 21 actuated by a cam following roller 28 in such a manner that they remain in the down position indicated by d whenever the fixture 100 is not in the loading position. The clamp stems 10 are forced down by the springs 15 acting against the collars 16 with forces $F_2$. As the stems 10 move down, the cam follower bearings 12 attached to the stems move against the cams 17 causing a rotational motion of the stems 10 and the clamps 9 through an angle $\alpha$ (on the order of 90°). The design of the fixture, relative to the cams is such that rotational motion occurs only when the pads 6 are not in contact with the inner surface 4 of the panel 1. The shape of cam 17 is such that both constrained vertical motion and rotational motion are provided as the stem 10 moves through its vertical stroke. The cam 17 is fixed to the machine table 8.

The clamps 9 remain in the down position except when the machine table and the fixture are in the loading position. When the grinding cycle is completed and the machine table approaches the unloading position, the cam 18 is shaped to cause an opposite sequence of actions such that the stems 10 are moved upward in the direction u causing the clamps 9 to lift vertically and rotate through the same angle $\alpha$ to open the fixture for removal of the panel.

FIG. 2 shows the forces and motions involved in the action of parts of the fixture. The broken lines show the positions of the panel and the clamps in the various stages of motion. The solid lines show the panel and the clamps in the clamping position.

In the loading position at the start of the cycle, the outer surface 5 of the panel 1 rests on the spring loaded buttons 7 at the elevation i. At the same moment, the clamps 9 are in the rotated position as shown at e in FIG. 1 with their top surfaces at elevation j such that the pads 6 are not in contact with the inner surface 4 of the panel 1. Therefore, the bottom surfaces 19 of the clamps 9 are at elevation k and not in contact with the reference surface 20 of the posts 11. At this time forces $F_1$ and $F_2$ equal zero. As the machine table 8 moves away from the loading position and stems 10 moves in the direction d, the clamps 9 complete their rotational motion in the distance f prior to coming in contact with the inner surface 4 of the panel 1. When the pads 6 come in contact with the inner surface 4, the clamps 9 continue to move in the direction d through the distance g expanding the springs 15 in FIG. 1 while at the same time compressing springs 14 under the buttons 7. A transfer of forces occurs such that force $F_1$ is developed which presses the inner surface 4 of the panel 1 against the lower surfaces of the pads 6 which are at the same elevation of the reference surface 20 of the posts 11. The design of the spring system is such that the total of the forces $F_1$ is at all times greater than the grinding force $F_3$ exerted by the grinding wheel 13 in normal operation.

Positioning: FIG. 2*b* illustrates how the panel 1 is positioned relative to its inner surface 4 in close proximity to a grinding wheel 13.

It is essential that the inner surface 4 of the panel 1 be in a flat plane to enable the grinding wheel to grind a parallel plane represented by the land 3 on the rails of the support structure 2. In a production machine, all panels must have the same reference surface. In this invention, the reference surface for the inner surface of the panel is the upper surface 20 of the posts 11.

When the fixture 100 is in the clamped state, the bottom surfaces 19 of the clamps 9 rest on the reference surface 20 of the posts 11. To assure a uniform reference surface at all stations in the fixture 100, the posts 11 are permanently attached to the surface of the machine table at t and the reference surfaces 20 are ground, as part of the fixture construction, using the same grinding head 13 used to grind the land 3 on production parts during the production cycle. A total of 32 posts 11 are installed in the fixture and all are ground to exactly the same elevation indicated at 1. Thus, when the clamps 9 are fully in their down position, their bottom surfaces 19 represents a reference surface for the inner surface 4 of the panel 1 which is held against the reference surfaces 19 by forces $F_1$ exerted by the springs 14 under the buttons 7.

Grinding

Successful grinding of a smooth burr-free land 3 in a plane flat within approximately 0.0005" and parallel at a distance of approximately 0.290" from the inner surface of a panel within approximately plus or minus 0.002" at all points depends on the invention of a suitable fixture, as described above, a proper grinding technique, choice of a suitable grinding wheel, a suitable coolant flow, an adequate coolant cleaning system, selection of the correct grinding wheel and proper in-process gauging methods. Many of these parameters can only be established by empirical methods.

A truly flat surface can be achieved only by using a large wheel covering the entire area of grinding and by continuously moving the work under the wheel or by a process commonly known as planetary grinding wherein the spindle of the grinding wheel is mounted on an offset axis from another spindle having its own and separate speed and direction of rotation. Such a process is illustrated in FIG. 3.

Figure 3:
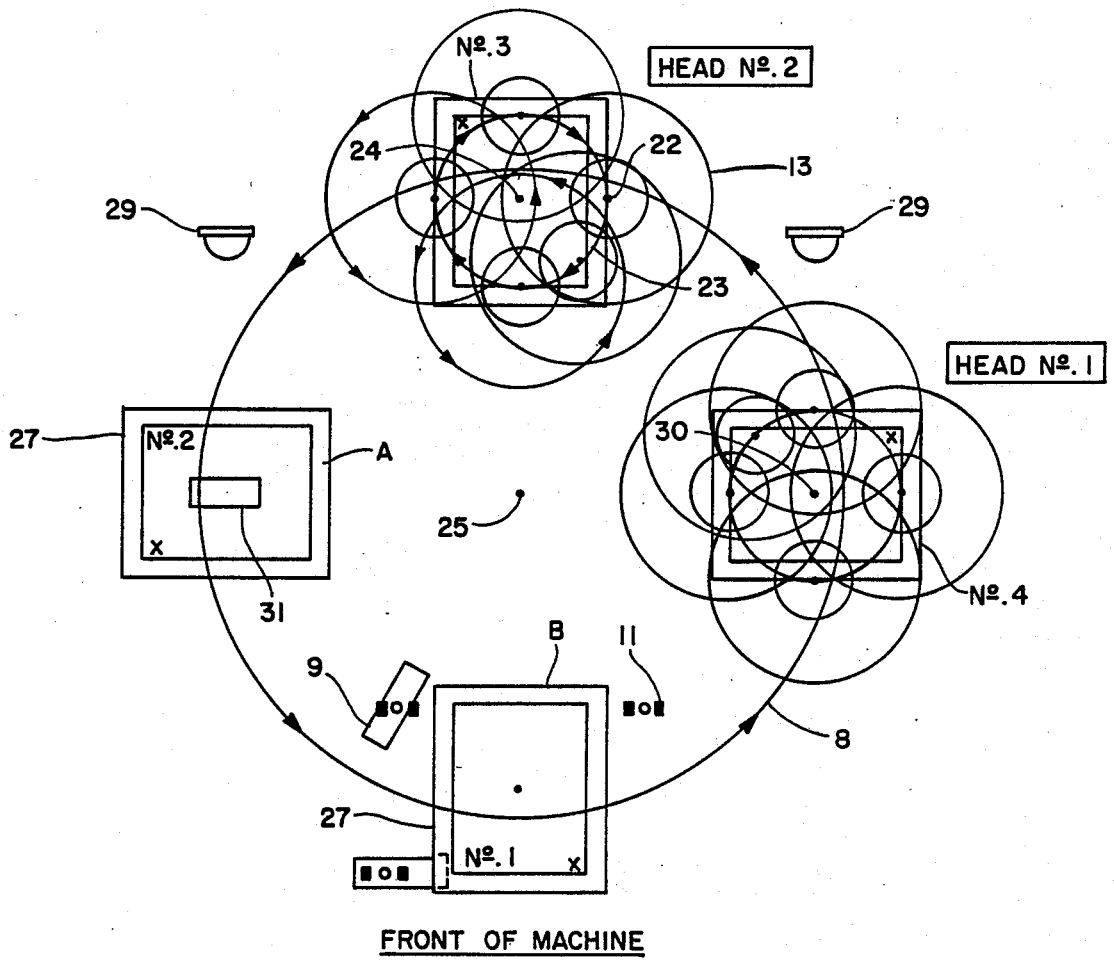
FIG. 3 illustrates the table of the grinding machine and its four station scheme for production grinding. The direction of motion of the table as compared to the planetary motion of the grinding wheels is depicted.

At head No. 2 on FIG. 3, a fourteen inch grinding wheel 13 is mounted on a spindle 22 turning at approximately 1200 revolutions per minute in a counterclockwise direction. The spindle 24, turning at approximately 60 revolutions per minute, is affixed to a rotating machine element whose spindle 24 turns in a clockwise direction relative to a fixed location in the body of the grinding machine. The net effect is that spindle 22 of the grinding wheel moves in a circle 23, called a planetary orbit, causing the surface of the grinding wheel to have a combination of transverse and rotational motion. The combined motion adds a wiping action to the grinding process. In the production application, a Mattison Model 24A2P Planetary Head Grinder is suitable for grinding the land 3. While not essential to describing the concept of the invention, this particular grinding machine is equipped with a second spindle system and grinding head as shown for Location #4 on FIG. 3.

Production of a smooth burr-free surface on a metal rail requires a grinding wheel with the correct combination of the proper abrasive material, abrasive grit size, binder resin and the correct final density of the materials used in making the grinding wheel. The entire wheel composition must be such that the binder material disintegrates at such a rate that the metal is constantly being exposed to new abrasive cutting edges so as to prevent tearing or burnishing thereby causing burrs. The binder must release dull abrasive grit before it can properly grind the metal rail. A correct grinding wheel composition can only be determined by experimental means in the process of inventing a solution to the overall problem of grinding the land 3 in accordance with the specifications for manufacturing a tube. It has been determined that a grinding wheel such as #3C150-K-B31 as made by Anchor Abrasive of Harvey, Ill. is suitable.

In FIG. 3, the spindle 25 of the machine table 8 is indicated where in the circle 26 shows the direction of motion of the table. The table moves in increments of 180 degrees. Four fixtures 27 are mounted on the table. Further, FIG. 3 shows that two grinding heads are used at spindles 24 and 30. Thirty two posts 11, eight for each fixture, permanently affixed to the table are provided. Also, open and closed positions of the clamps 9 are shown. Lastly, the sensing ball 29 of a Marposs Model E-15 solid state post-process height measuring gage is designated. As shown on FIG. 2*b* and as suggested by its position on FIG. 3, the ball touches the surface of the land 3 just prior to the fixture reaching the loading position as the machine table 8 rotates. Not shown is an equally important component of the process used for automatic continuous centrifugal cleaning of the coolant liquid to remove foreign matter. An Encyclon Model MA6-450DFM coolant filtration machine is suitable for this purpose.

Operation

This section briefly describes the operating cycle of the support structure grinding method. Two loading positions are open while grinding is in process.

In the starting position, the table 8 is locked in position by means of a hydraulically actuated "Shot Pin" 31 which precisely positions the table for robotics loading of the fixture. At this point the clamps 9 are open and the fixture 100 is ready to receive a panel 1. The grinding wheel spindles 24 and 30 may be in operation while loading is taking place.

Once the panel is loaded, the operator starts the cycle by activating two "Start" push buttons. The shot pin 31 retracts and the machine table 8 rotates 180 degrees. As a "just ground" rail of the support structure approaches the proximity of the gauging ball 29, the machine control system reduces the rotation speed of the machine table 8 permitting the ball 29 to rise and move slowly over the surface of the land 3 thereby gauging its height. The slowing of the machine table speed is significant because the width of the land is on the order of 1/16" wide. There must be sufficient time to eliminate measuring transients in gauging over so short a distance. If the gauging system perceives that grinding wheel wear adjustment is required, wheel wear compensation downfeed is automatically executed. Once gauging is complete, the table 8 returns to its high speed mode and completes its 180° rotation to the loading position. The shot pin 31 is then extended locking the machine table into position for the next panel unloading and reloading cycle.

Simultaneously, the grinding process for previously loaded panels begins as the machine lowers the grinding heads 0.030" using a 100:1 ratio hydraulically controlled mechanism operating at an experimentally determined advance rate of 0.001" per second. Once the wheel advance mechanism has reached its fully down position, the grinding wheel continues to orbit over the support structure until a part of the cycle called "spark out" is completed. The spark out interval is critical to the process in that it is during this part of the grinding process that uniform rail flatness is achieved. Lastly, the grinding wheel is retracted, and the machine table again rotates 180 degrees thereby repeating the complete cycle.

While particular embodiments of the invention have been shown and described, it will be obvious to those skilled in the art that changes and modifications may be made without departing from the invention in its broader aspects; and, therefore, the aim in the appended claims is to cover all such changes and modifications as fall within the true spirit and scope of the invention.

What is claimed is:

1. In the manufacture of a tension mask color cathode ray tube front assembly, the method comprising:

providing a flat glass front panel having a planar inner surface;

mounting a shadow mask support structure on said planar inner surface with an unfinished shadow mask receiving surface spaced an approximate distance from said planar inner surface of said glass front panel; and removing material from said unfinished mask receiving surface to produce a finished mask receiving surface which is parallel to and precisely spaced from said planar inner surface of said glass front panel.

2. In the manufacture of a tension mask color cathode ray tube front assembly, the method comprising:

providing a flat glass front panel having a planar inner surface;

grinding said planar inner surface to a predetermined flatness;

mounting a shadow mask support structure on said planar inner surface with an unfinished metal shadow mask receiving surface spaced an approximate distance from said planar inner surface of said glass front panel;

grinding material from said unfinished mask receiving surface to produce a finished mask receiving surface which is parallel to and precisely spaced from said planar inner surface of said glass front panel.

3. In the manufacture of a tension mask color cathode ray tube front assembly, the method comprising:

providing a flat glass front panel having a planar inner surface;

mounting a shadow mask support structure on said planar inner surface with an unfinished shadow mask receiving surface spaced an approximate distance from said planar inner surface of said glass front panel;

supporting said glass front panel with reference to a plane coincident with said planar inner surface;

removing material from said unfinished mask receiving surface with reference to said plane to produce a finished mask receiving surface which is parallel to and precisely spaced from said plane and thus said planar inner surface of said glass front panel.

4. In the manufacture of a tension mask color cathode ray tube front assembly, the method comprising:

providing a flat glass front panel having a planar inner surface;

grinding said planar inner surface to a predetermined flatness;

mounting a metal shadow mask support structure on said planar inner surface with an unfinished shadow mask receiving surface spaced an approximate distance from said planar inner surface of said glass front panel;

supporting said glass front panel with reference to a plane coincident with said planar inner surface; and grinding material from said unfinished mask receiving surface with reference to said plane to produce a finished mask receiving surface which is parallel to and precisely spaced from said plane and thus said planar inner surface of said glass front panel.

5. In the manufacture of a tension mask color cathode ray tube front assembly, the method comprising:

providing a flat glass front panel having an inner surface;

securing a shadow mask support structure on said inner surface with an unfinished shadow mask receiving surface spaced from said inner surface of said glass front panel; and removing material from said unfinished mask receiving surface to produce a flat mask receiving surface adapted to support by weldments a tensed shadow mask.

6. In the manufacture of a tensed foil mask cathode ray tube front assembly, a method comprising:

providing a glass front panel having a planar inner surface;

mounting on said inner surface a mask support for receiving a foil mask, said support structure having an unfinished mask receiving surface spaced an approximate distance from said outer surface;

positioning said glass front panel such that said planar inner surface is in a known reference plane;

measuring the distance from said plane of said mask receiving surface to the plane of said planar inner surface of said front panel; and removing material from said unfinished mask receiving surface in response to distance measurements thus developed to produce a mask receiving surface on said mask support structure in a plane parallel to and at a precise fixed distance from the plane of said planar inner surface of said glass front panel.

* * * * *